US005628302A

United States Patent [19]

Schatz et al.

[11] Patent Number: 5,628,302

[45] Date of Patent: May 13, 1997

[54] BURNER ASSEMBLY AND PAN SEAL

[75] Inventors: Steven M. Schatz, New Palestine; Stanley H. Beach, Indianapolis, both of Ind.

[73] Assignee: Maytag Corporation, Newton, Iowa

[21] Appl. No.: 493,163

[22] Filed: Jun. 21, 1995

[51] Int. Cl.[6] ..... F24C 3/00

[52] U.S. Cl. ..... 126/39 R; 126/214 C; 126/215; 431/202

[58] Field of Search ..... 126/41 R, 39 R, 126/39 H, 39 K, 40, 42, 214 C, 215, 211; 431/263, 202, 154

[56] References Cited

U.S. PATENT DOCUMENTS

| | | | |
|---|---|---|---|
| 3,625,196 | 12/1971 | Craver | 126/39 H |
| 3,809,055 | 5/1974 | Craver | 126/39 H |
| 3,822,982 | 7/1974 | Du Perow | 431/193 |
| 3,874,841 | 4/1975 | Ferlin | 431/193 |
| 4,354,478 | 10/1982 | Contini | 126/39 E |
| 4,527,539 | 7/1985 | Kay | 126/39 R |
| 4,971,024 | 11/1990 | Albon et al. | 126/39 B |
| 5,002,038 | 3/1991 | Riehl | 126/39 R |
| 5,040,970 | 8/1991 | Riehl | 431/264 |
| 5,046,477 | 9/1991 | Bennett et al. | 126/39 B |
| 5,052,920 | 10/1991 | Warren et al. | 431/354 |
| 5,125,390 | 6/1992 | Riehl | 126/39 R |
| 5,152,276 | 10/1992 | Brock et al. | 126/39 R |
| 5,160,255 | 11/1992 | Sigler | 431/266 |
| 5,160,256 | 11/1992 | Riehl | 431/266 |
| 5,246,365 | 9/1993 | Himmel et al. | 431/263 |
| 5,266,026 | 11/1993 | Riehl | 431/264 |
| 5,313,929 | 5/1994 | Thurk et al. | 126/39 B |
| 5,328,357 | 7/1994 | Riehl | 431/266 |

*Primary Examiner*—Larry Jones
*Attorney, Agent, or Firm*—Brinks Hofer Gilson & Lione

[57] ABSTRACT

A burner assembly is provided that includes a burner pan having a peripheral portion adapted to engage a range top at the periphery of a burner opening and a sealed burner in central portion of the burner pan. A resilient elastic seal straddles the peripheral portion of the burner pan so as to be disposed between the burner pan and the range top and between the burner pan and the burner grate. The elastic seal retains the burner grate in position slightly above the range top and provides a seal to close the burner opening.

15 Claims, 2 Drawing Sheets

BURNER ASSEMBLY AND PAN SEAL

The present invention relates to burner assemblies and seals and particularly, to sealed burner assemblies for use with range tops, particularly glass range tops. Still, more particularly, the invention relates to seals that engage the edge of the burner pan, provide an improved sealed burner assembly, and cushioned support for a burner grate.

BACKGROUND OF THE INVENTION

Prior art burner assemblies, and particularly prior art sealed gas burner assemblies have not been entirely satisfactory. It is desirable to provide "sealed burners" on cooking ranges. A primary requirement in the design of sealed burners is the prevention of liquid or other spills from leaking into the burner box interior. It is, therefore, common practice within the industry to provide "pan seals" to prevent leakage of spills into the burner box interior. The seal is usually either a closed loop, physically joined at its extremities, or a non-contiguous seal, unjoined at its extremities. Typically, the pan seals are loosely retained below and along the perimeter of the burner pan. The loose application may be at the perimeter of the burner pan itself or at the perimeter of the opening of the metallic or glass range top in which the burner pan is located.

Because of the loose application of the seal, sealed burner pans typically require a perimetral flange to align and retain the seal. Unfortunately, the perimetral flange increases the tooling expense and therefore the cost of the burner pan. Also, in conventional burner pans, there is a need for good porcelain coverage and good porcelain adherence at the circumference of the burner pan to avoid corrosion and degradation of appearances. The presence of a perimetral flange increases the difficulty of obtaining and maintaining the porcelain enamel coating of the burner pan. A further problem is heat transfer between the burner and grate and seal, particularly with sealed gas burners.

Another problem associated with conventional burner assemblies is the "clunk" sound made when the burner grates are put down on the burner pan and rangetop, which is an irritant to consumers. The invention addresses these problems and others, as will be apparent to those skilled in the art from the drawings and description that follows.

SUMMARY OF THE INVENTION

The present invention comprises, in one aspect, a gas range having a sealed range top with at least one burner opening, at least one removable burner assembly, including a burner pan having a peripheral portion adapted to engage the range top at the periphery of the burner opening and a sealed burner in its central portion with a resilient elastic seal between the peripheral portion of the burner pan and the range top that is formed to engage the peripheral portion of the burner pan and has sufficient length and elasticity so that it may be stretched over the peripheral portion of the burner pan and, through its resilience, engage and be retained on the peripheral portion of the burner pan. According to another aspect of the invention, the peripheral portion of the burner pan includes a bead and the resilient elastic seal is formed with an internal groove that engages the bead. In preferred embodiments, the bead is stamped into the peripheral portion of the burner pan to project outwardly from one side of the burner pan and be spaced closely adjacent its periphery, and the internal groove of the seal is formed to provide bead-engaging surfaces extending outwardly on both sides.

In a further aspect of the invention, at least one grate is seated and located on the range top about the sealed burner by the resilient elastic seal.

The invention provides a burner assembly for a range top, including a burner pan and burner positioned on a range top, a grate positioned above the burner pan and including a seating surface and a peripheral skirt and means for seating the burner pan on the range top and for resiliently supporting the seating surface of the grate, the peripheral skirt providing engagement with the grate seating means and substantial concentricity of the gas burner and grate. As indicated above, in sealed gas ranges, the means for seating and supporting the grate forms a burner seal adopted to engage the peripheral edge of the burner pan, and the grate includes a seal-engaging surface that engages and sits on the resilient elastic seal. In preferred embodiments of the invention, the grate and peripheral portion of the burner pan each have at least one inter-engaging asymmetric surface for orientation of the grate with respect to the gas burner.

The present invention thus provides a circular seal which engages the peripheral edge of the burner pan and provides a seal which eliminates the "clunk" sound made when the grates are put down on the burner pan and rangetop. Additionally, the invention provides a secure yet palpably soft feel to the grate, which consumers like and perceive as quality.

Other objects, features and advantages of the invention will be apparent to those skilled in the art upon consideration of the following detailed description of a preferred embodiment exemplifying the best mode of carrying out the invention as presently perceived.

DETAILED DESCRIPTION OF THE DRAWINGS

Figure 1:
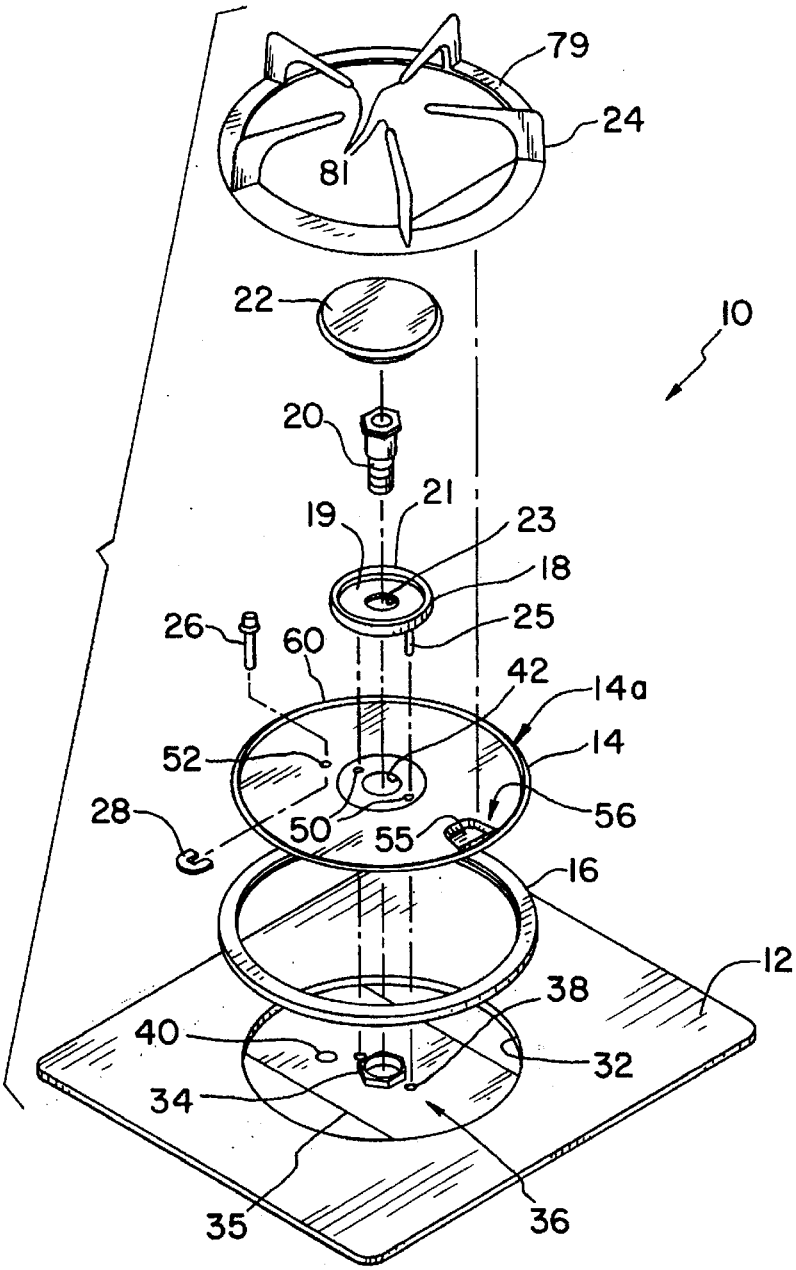
FIG. 1 an exploded view of a sealed burner/grate assembly of the invention.
Figure 2:
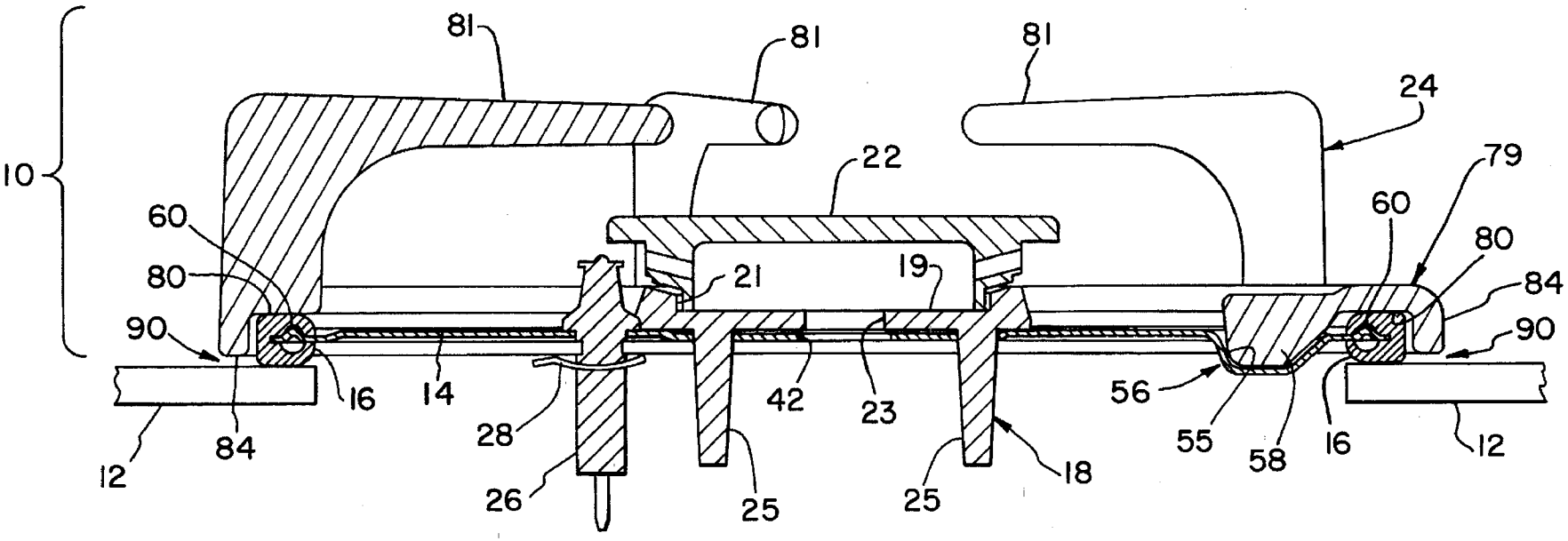
FIG. 2 is a cross-sectional view taken at a vertical plane passing through the center of the burner/grate assembly of FIG. 1 and the range top showing the engagement of the burner pan, seal, and grate.

As illustrated in FIGS. 1 and 2, a burner/grate assembly 10 is mounted to a range top 12. The burner/grate assembly includes a burner pan 14, a burner pan seal 16, a burner base 18, a venturi 20, a burner head 22, a grate 24, and an igniter 26, held in place by a retaining clip 28.

A conventional range top 12 includes a burner opening 32 for receiving the burner/grate assembly 10. A venturi-receiving fixture 34 is positioned below the range top 12 and centered in the burner opening 32. The venturi-receiving fixture 34 is fastened to a cross-support member 35 in the burner box interior 36. A pair of holes 38 are formed in the cross-support member 35 on opposite sides of the venturi-receiving fixture 34. The holes 38 are positioned to receive a burner base 18. An igniter receiving hole 40 is also formed in the cross support member 35.

The burner pan 14 includes a central hole 42 for receiving the venturi 20, a pair of holes 50 disposed along side the central hole 42 for receiving the burner base 18 and an igniter-receiving aperture 52. The burner base receiving holes 50 are positioned in registry with the burner base receiving holes 38, and the igniter receiving hole 52 in the burner pan is in registry with the igniter-receiving hole 40 formed in the cross support member 35 within the burner box interior 36 and in registry with the burner ports. The burner pan 14 also includes an asymmetric surface 55 which forms an indexing indentation 56 for receiving an indexing protrusion 58 (FIG. 2) formed on the grate 24 and conforming with the indexing indentation 56. The indexing indentation 56 and protrusion 58 cooperate in aligning the grate with the burner pan 14 to retain it in the proper position thereon. In preferred embodiments, the burner pan 14 includes a peripheral portion 14*a* that can be formed with a peripheral bead 60. As indicated in FIG. 2, one such peripheral bead may be formed as an outward projection of the burner pan, for example, by stamping dies.

The burner base 18 includes a circular disk portion 19 and an annular shoulder 21 which extends upwardly from the periphery of the circular disk portion 19. The circular disk portion 19 includes a central venturi-receiving hole 23 and a pair of legs 25 extending downwardly from the circular disk portion 19. The legs 25 are positioned on opposite sides of the central venturi-receiving hole 23.

Figure 3:
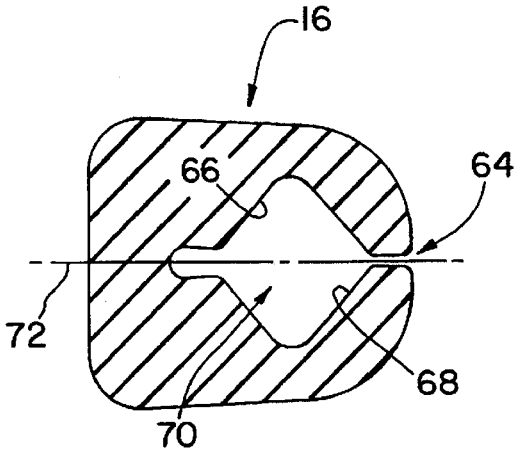
FIG. 3 is an enlarged cross-sectional view taken at a plane crossing the seal of FIGS. 1 and 2.

A resilient elastic seal 16 is formed to engage the peripheral portion of burner pan 14 and has sufficient peripheral length and elasticity that it may be stretched over the peripheral portion 14*a* and through its resilience, engage and be retained on the peripheral portion 14*a*. As shown in FIGS. 2 and 3, the seal 16 can include an internal groove 64 for engaging the peripheral portion 14*a* of the burner pan 14. In preferred embodiments, as illustrated in FIG. 3, the internal groove 64 includes an annular void 70 defined by upper and lower engaging surfaces which are shaped to conform to, and engage a peripheral bead 60 formed on the burner pan 14. Preferably, the void 70 is symmetric about a central plane 72 to avoid having a "right-side-up" and simplifying installation of the seal 16 on the burner pan 14.

To assemble the burner/grate assembly 10, the elastic seal 16 is stretched and positioned around the periphery of the burner pan 14 so that the peripheral portion 14*a* of the burner pan 14 can be fitted into the internal groove 64 of the seal 16 and the relaxation of the seal 16 the force generated by this resilience of the seal material will hold the seal 16 in position on the burner pan 14. In preferred embodiments, the peripheral bead 60 will fit into an internal annular void 70 formed in the seal 16, as illustrated in FIG. 2 with the peripheral bead 60 engaging one of the inner-engaging surfaces 66 or 68 of the annular void 70. The seal 16 thus holds itself in position to seal the burner pan 14 to the range top 12.

With the seal 16 on the burner pan 14, the burner pan 14 is set on the range top 12 so that the venturi-receiving fixture 34 is in registry with, but does not pass through, the central hole 42 formed in the burner pan 14. The burner base receiving apertures 50 and 38 are positioned in registry. The burner base 18 is installed in the burner pan by inserting legs 25 into the burner base receiving holes 50 and 38. The igniter 26 is inserted through the igniter receiving holes 52 and 40, and the venturi 20 is inserted in the venturi-receiving fixture 34 through the central hole 42 and the central venturi-receiving hole 23 formed in the burner base 18. Insertion of the legs 25 into holes 50 and 38 and the igniter 26 with holes 52 and 40 serve to align the burner pan 14 within the burner opening 32 and retain the burner pan 14 in position. The burner head 22 is positioned on top of the burner base 18. The assembly may then be removably fastened together by any suitable fasteners, as is apparent to those skilled in the art.

If it becomes necessary to remove the burner pan, for example, for repairs or cleaning, the seal 16 will be retained undamaged on the burner pan 14 as it is removed from the range top, and will reseal the burner assembly to the range top when it is replaced. If the seal 16 becomes damaged, it can be easily replaced by stretching a new seal into engagement with the peripheral portion of the burner pan.

As indicated in FIGS. 1 and 2, the seal 16 can also provide a resilient support for a burner grate 24. Such a grate 24 includes a base 79 and pan supporting arms 81. The base includes an underside seating and seal-engaging surface 80 to fit and mate with the seal 16. The grate 24 is indexed to the burner pan 14 to assure aesthetically pleasing appearance and, more importantly, to ensure the grate's pan-supporting arms 81 are not located directly above the burner's ports. This arrangement helps to keep the arms 81 relatively cool and thereby minimize conduction of heat through the grate's pan-supporting arms 81 to the pan seal 16 and helps prevent thermal damage to grate fingers and the finish on the fingers. A peripheral skirt 84 depends downwardly from the seal-engaging surface 80 and cooperates with the seal 16 to locate and retain the grate 24 concentric with the burner 22. In addition, the peripheral skirt 84 and the seal 16 cooperate to leave a gap 90 between the grate 24 and the range top 12. This gap 90 provides a soft feel to engagement of pan and the grate 24 and reduces the likelihood of the "clunk" otherwise apparent in conventional range tops and also reduces the risk of porcelain damage to pan and glass damage to glasstop.

Thus, the invention also provides a burner assembly for a range top 12 including a burner pan 14, and a burner 22 and a grate 24 for the burner 22, where the burner pan 14 is provided with means 16 for seating and resiliently supporting the grate. The grate has a surface 80 and a peripheral skirt 84 to engage the seating and supporting means 16, provide soft-feeling support and location of the grate 24 with respect to the burner 22, and permit the grate 24 to be handled without the annoying noise or risk of porcelain damage or glass damage associated with the engagement of metal parts, and/or glass and metal parts.

Although the invention has been described in detail with reference to certain preferred embodiments, variations and modifications exist within the scope and spirit of the invention as described and defined in the following claims.

We claim:

1. In a gas range including a range top with at least one burner opening; at least one removable burner assembly, including a burner pan having a peripheral portion adapted to engage the range top at the periphery of the burner opening and a sealed burner in its central portion; and a seal between the peripheral portion of the burner pan and the range top, the improvement comprising a resilient elastic seal formed to engage the peripheral portion of the burner pan and having sufficient peripheral length and elasticity that it may be stretched over the peripheral portion of the burner pan and through its resilience engage and be retained on the peripheral portion of the burner pan.

2. The gas range of claim 1 wherein the peripheral portion of the burner pan includes a bead, and the resilient elastic seal is formed with an internal groove that engages the bead.

3. The gas range of claim 2 wherein the bead is stamped into the peripheral portion of the burner pan to project outwardly from one side of the burner pan spaced closely adjacent its periphery, and the internal groove is formed to provide bead-engaging surfaces extending outwardly on both sides.

4. The gas range of claim 1 wherein the resilient elastic seal is silicon rubber with a durometer in the range of 40–60.

5. In the gas range of claim 1 further including at least one grate supported by said range top about the sealed burner wherein the resilient elastic seal is formed to extend over the upper surface of the burner pan and the grate includes a base portion that engages and sits on the resilient elastic seal.

6. The gas range of claim 5 wherein the base portion of the grate and peripheral portion of the burner pan each have at least one inter-engaging asymmetric surface for orientation of the grate with respect to the gas burner.

7. A sealed gas burner assembly for a glass range top, comprising:

a burner pan with a peripheral portion for support by the glass range top, a gas burner sealed with the central portion of the burner pan, and a resilient elastic seal member having an internal groove adapted to receive the peripheral portion of the burner pan and having sufficient length and elasticity to permit stretching for receipt of the peripheral portion of the burner pan in the internal groove and sufficient resilience to engage and be retained on the peripheral portion of the burner pan.

8. A grate for use with the sealed gas burner of claim 7 comprising a peripheral base portion and a plurality of pan supporting arms extending inwardly from the peripheral base portion, said base portion being adapted for engagement with and support by the resilient elastic seal member of the sealed gas assembly.

9. The grate of claim 8 wherein the resilient elastic seal extends substantially above the upper surface of the burner pan and the base portion of the grate includes a seal-engaging surface adapted to sit on the resilient elastic seal and a peripheral skirt depending downwardly from the seal-engaging surface.

10. A burner assembly for a range top, comprising:

a burner pan positioned on the range top, a burner positioned in the central portion of the burner pan, a grate positioned above the burner pan and including a seating surface and a peripheral skirt, and means for seating the burner pan on the range top and for resiliently supporting the seating surface of the grate to provide a gap between the peripheral skirt and the range top, said peripheral skirt providing engagement with the grate seating means and substantial concentricity of said gas burner and grate.

11. The burner assembly of claim 10 wherein the burner pan includes a peripheral portion and the means for seating and supporting the grate forms a burner seal adapted to engage the peripheral portion of the burner pan.

12. The burner assembly of claim 11 wherein the seal maintains the peripheral portion of the burner pan in parallel spaced-apart relation with, and between, the range top and the seating surface of the grate and in a spaced-apart relation with the peripheral skirt of the grate.

13. The burner assembly of claim 11 wherein the peripheral portion of the burner pan includes a bead extending around its periphery and the seal includes an internal void configured to engage the bead.

14. The burner assembly of claim 10 wherein the burner pan includes first indexing means and the grate includes second indexing means for engaging the first indexing means to align the grate in a predetermined relation with the gas burner.

15. The burner assembly of claim 14 wherein the gas burner includes a plurality of gas ports and the grate includes a plurality of pan supporting arms, the supporting arms being positioned between gas ports when the grate and gas burner are in the predetermined relation.

* * * * *